US005301853A

United States Patent [19]

Addison et al.

[11] Patent Number: 5,301,853

[45] Date of Patent: Apr. 12, 1994

[54] OPEN TOP PLASTIC DRUM WITH PLASTIC COVER

[75] Inventors: Robert A. Addison, Rancho Cucamonga, Calif.; John P. Berg, St. Paul, Minn.

[73] Assignee: Greif Bros Corporation, Delaware, Ohio

[21] Appl. No.: 87,133

[22] Filed: Jul. 2, 1993

Related U.S. Application Data

[63] Continuation of Ser. No. 884,047, May 14, 1992, abandoned, which is a continuation of Ser. No. 697,786, May 9, 1991, abandoned.

[51] Int. Cl.[5] ..... B65D 45/00

[52] U.S. Cl. ..... 200/320; 220/307; 220/634

[58] Field of Search ..... 220/320, 319, 355, 307, 220/306, 634, 659, 656, 669, 674, 675, 672; 215/1 C

[56] References Cited

U.S. PATENT DOCUMENTS

| | | | |
|---|---|---|---|
| 3,424,340 | 1/1969 | Rocher | 220/320 |
| 3,499,574 | 3/1970 | Yates, Jr. | 220/320 X |
| 4,177,934 | 12/1979 | Hammes et al. | 220/320 X |
| 4,349,119 | 9/1982 | Letica | 220/675 X |
| 4,500,010 | 2/1985 | Schütz | 220/320 |
| 4,674,650 | 6/1987 | Hamilton et al. | 220/320 X |
| 4,741,453 | 5/1988 | Stolzman . | |
| 4,805,798 | 2/1989 | Stolzman . | |
| 4,813,592 | 3/1989 | Stolzman . | |
| 4,880,138 | 11/1989 | Pfeiffer et al. | 220/320 |
| 4,893,861 | 1/1990 | Stoltzman . | |

*Primary Examiner*—Joseph Man-Fu Moy

*Attorney, Agent, or Firm*—Kane, Dalsimer, Sullivan, Kurucz, Levy, Eisele & Richard

[57] ABSTRACT

A plastic drum assembly includes a plastic body with an open top, terminated in a neck having two annular flexing zones, a plastic cover, and a ring for securing the cover to the body. The cover may also have flexing regions corresponding to the flexing regions on the neck. The flexing regions cooperate to permit the neck and the cover to flex in a hinging action in presence of an impact on the body to insure that the cover is not separated, thereby preventing spillage.

16 Claims, 5 Drawing Sheets

OPEN TOP PLASTIC DRUM WITH PLASTIC COVER

This is a continuation of copending application Ser. No. 07/884,047 filed on May 14, 1992 now abandoned, which is a continuation of copending application Ser. No. 07/697,786 filed on May 9, 1991 now abandoned.

BACKGROUND OF THE INVENTION

1. Field of Invention

This invention pertains to an all plastic drum of the kind having an open top and a cover, and more particularly to a plastic drum designed for safely transporting various powdery materials and the like.

2. Description of the Prior Art

Open top plastic drums provided with round plastic covers are very desirable as a means of transporting various types of solid materials, which may be granular, in the form of powders, as well as semi-liquids or pastes. Depending on the nature of the material to be transported, these drums are subject to different governmental regulations. Drums for regulated materials, i.e. materials dangerous or hazardous to public health, are regulated by the United States Department of Transportation (DOT) as well as by the United Nations. The DOT requires that a drum for transporting a regulated material must be able to withstand the so-called drop test. This test consists of loading a drum with 400 pounds of sand, orienting the drum so that a vertical line passes through a top edge, the center of the drum, and a bottom edge, and then dropping the drum straight down, along the line, for a distance of 4 feet, onto a cement floor, so the impact is absorbed by the bottom edge. If the drum spills any of its contents, it has failed the test. This test simulates a worst-case condition for accidentally dropping a drum from a truck bed or a fork lift.

Drums for transporting non-regulated materials, such as adhesives, pastes, waxes, etc. are subject to other regulations promulgated by various and international organizations, including the United Nations. One such test, the tip-over test, consists of filling a drum with a heavy material, such as water, closing it and then tipping it over on a concrete floor on its side. Again, if the drum spills its contents, it fails the test.

As far as we know, the plastic drums presently available are not capable of passing both of these tests. The present drums fail to pass the tests because the impact generated during the tests forces the sidewalls of the drum to distort from a nominally cylindrical configuration to an oval or elliptical configuration. The round cover mounted on the drum is not able to conform to this drastic change and parts of the cover separate from the drum at least temporarily allowing the drum contents to spill.

OBJECTIVES AND SUMMARY OF THE INVENTION

In view of the above-mentioned disadvantage of the prior art, an objective of the present invention is to provide an open top plastic drum and cover assembly which are suitable for carrying both regulated and non-regulated materials by passing the drop and the tip-over test.

Another objective is to provide a plastic drum and a cover assembly wherein the cover is not knocked off during the handling and stacking of the drum.

Yet another objective is to provide a drum and cover assembly which is easy and inexpensive to manufacture.

Other objectives and advantages of this invention shall become apparent from the following description. A plastic drum assembly constructed in accordance with this invention includes a plastic generally cylindrical body with a neck forming an open top, coupling means including first and second axially spaced body hinging means; a plastic cover for closing said open top; and cover securing means for securing said plastic cover to said body to form a seal for said drum assembly. The first and second body hinging means cooperate to isolate said neck when said sealed drum assembly is subjected to impact to maintain said seal thereby avoiding spillage.

DETAILED DESCRIPTION OF THE INVENTION

Figure 1:
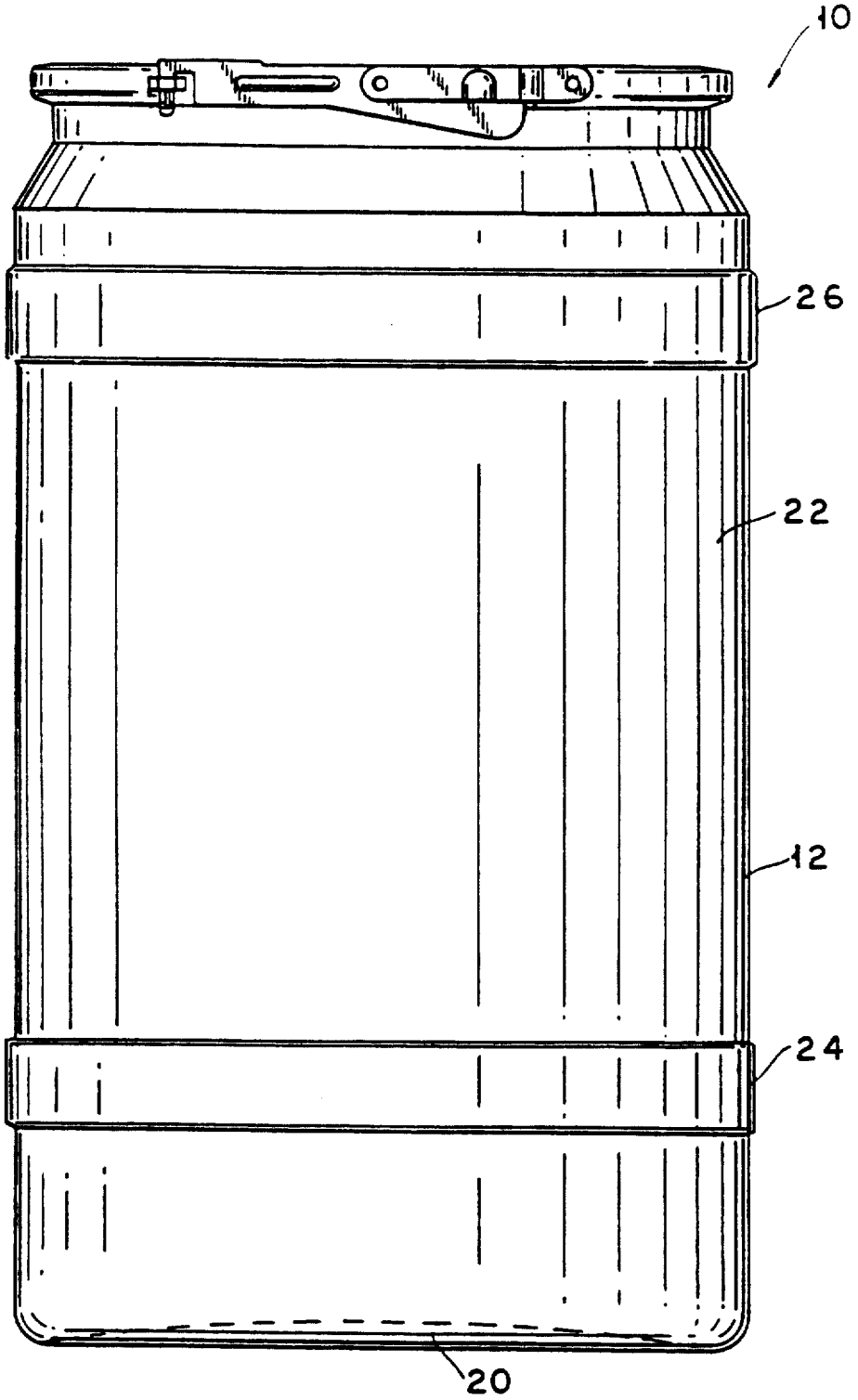
FIG. 1 shows a front elevational view of a closed drum assembly constructed in accordance with this invention.

A drum 10 constructed in accordance with this invention includes a generally cylindrical plastic body 12 with an open top defined by an opening 14. The opening 14 is closed by a cover 16, secured to body 12 by a ring 18.

Figure 2:
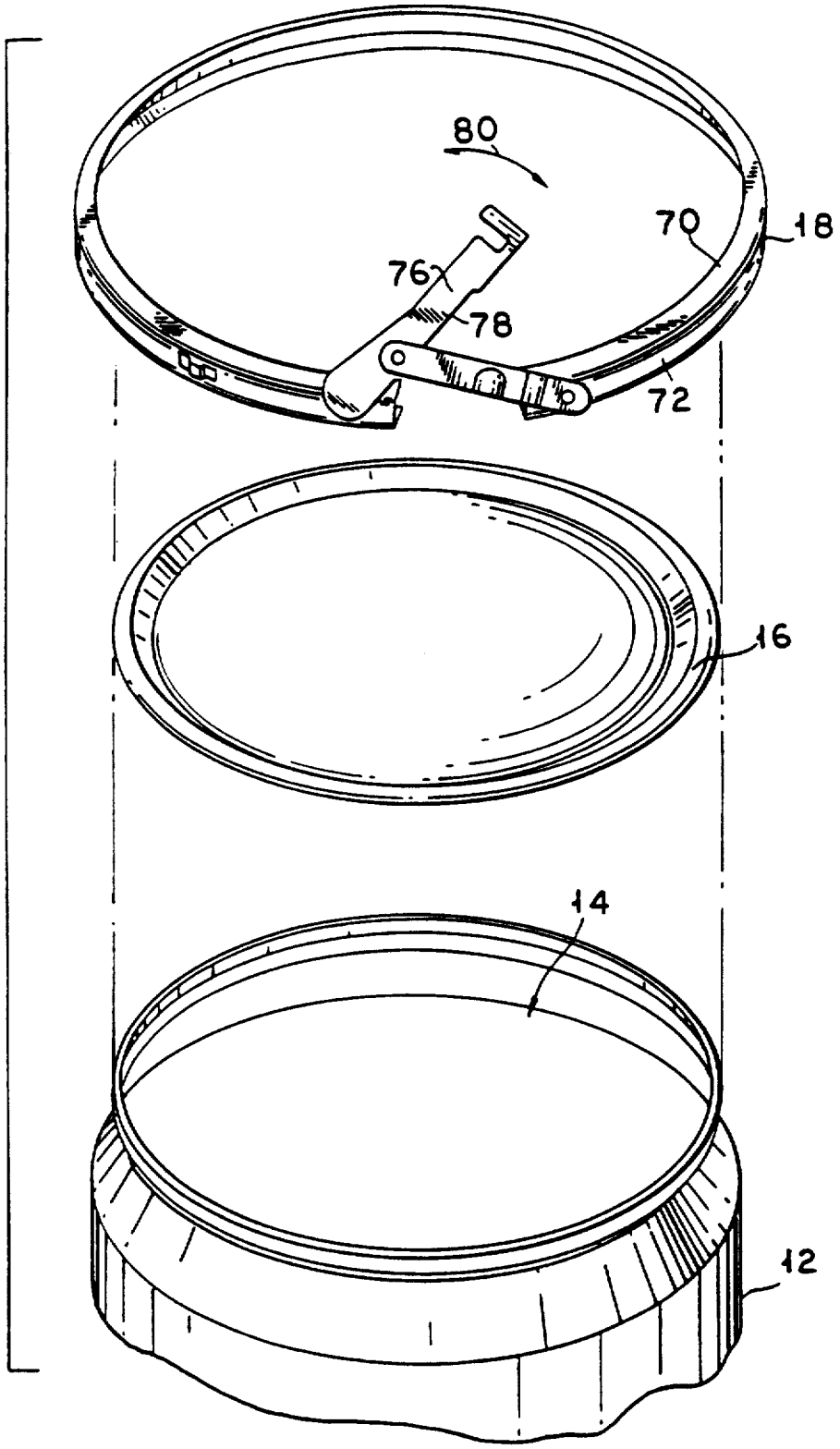
FIG. 2 shows an exploded view of the top portion of the drum assembly of FIG. 1.
Figure 3:
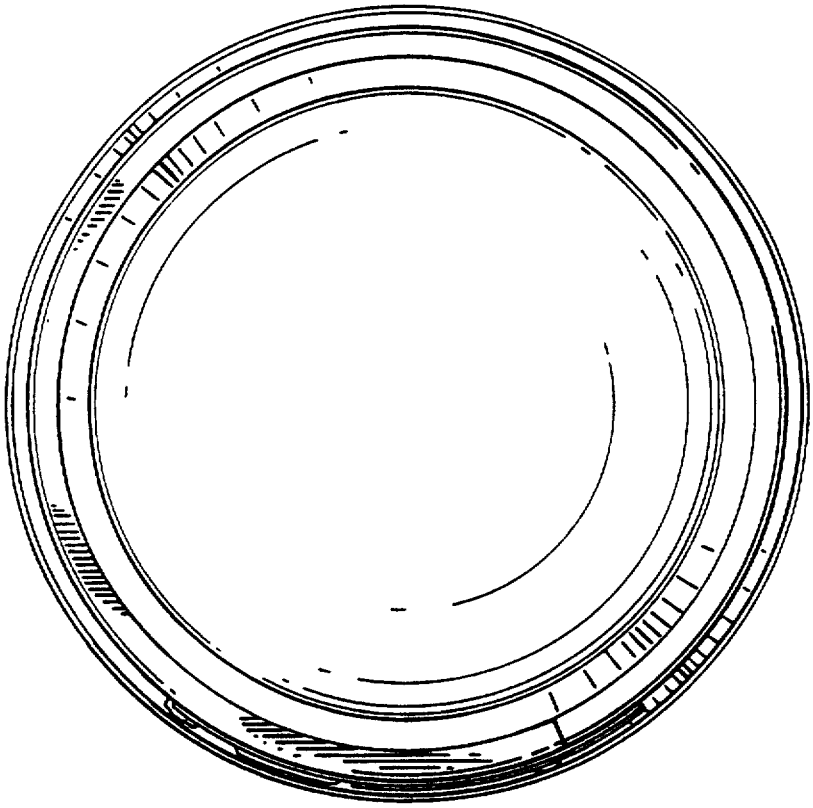
FIG. 3 shows a top view of the cover of FIGS. 1 and 2.

As seen in FIGS. 1 and 2, body 12 is made integrally of single piece of a plastic material, for example by molding. More particularly, body 12 includes an integral bottom portion 20 and a cylindrical sidewall 22. Approximately at equal distance from the top and bottom, sidewall 22 is formed with two rolling hoops 24, 26. These hoops reinforce the drum and allow the drum to be rolled on a flat surface.

Figure 4:
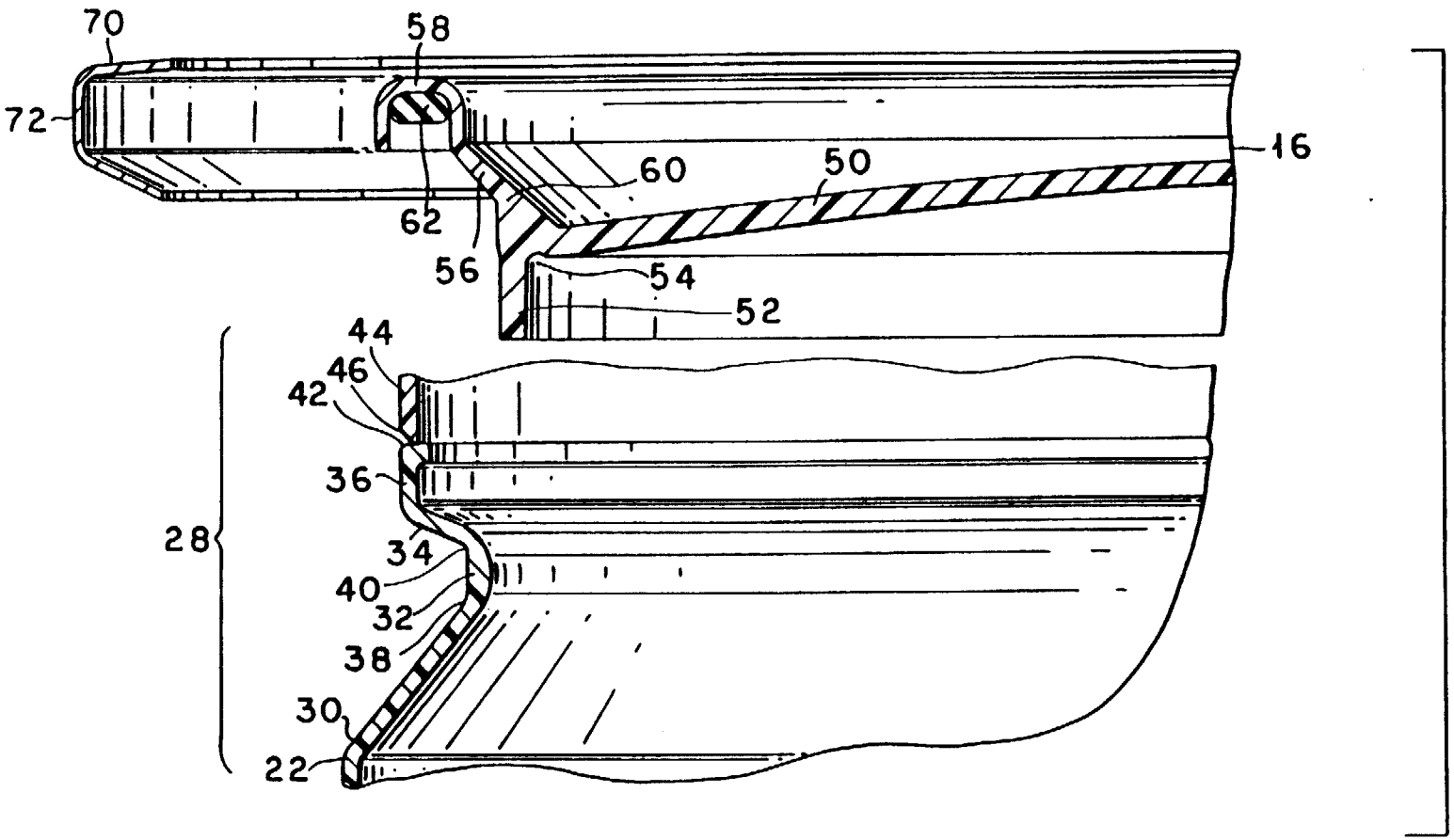
FIG. 4 shows an exploded side-sectional view of the top portion with the ring opened.

Above hoop 26, sidewall 22 narrows down to form a neck 36. As shown in FIG. 4, the drum neck 36 is connected to body 22 by coupling means which includes a downward conical wall 30, a lower cylindrical wall 32, and an upward conical wall 34. Importantly, the transition 38 between walls 30 and 32 defines a lower annular flexible region extending around the body 12. Similarly, the transition 40 between walls 32 and 34 defines an upper annular flexible region extending around the body 12. These two regions act like hinges and allow the neck 36 to flex slightly.

In addition the outer diameter of neck 36 is smaller than the outer diameter of the main portion of sidewall 22. The neck 36 is terminated by a smooth annular flat surface 42 disposed in a plane normal to the longitudinal axis of the drum. The radial width of annular surface 42 is substantially larger than the thickness of sidewall 22. This surface may be made for example by forming the drum body 12 together with a cylindrical wall 44 with a groove 46 separating wall 44 from body 22. After the body 22 and wall 44 are integrally molded, wall 44 can be cut off with a sharp bladed object, like a knife, and discarded, leaving a smooth surface 42. In the prior art, customarily, the drum body was formed with a cylindrical wall, but without the groove 46. After molding, the drum body was separated from the wall by sawing. The sawing produced undesirable shavings of plastic particles, and in addition resulted in an uneven top surface for the drum body.

Cover 16 includes a central disk 50 which may be slightly conical, as shown, with a dependent cylindrical skirt 52 extending both upwardly and downwardly of disk 50 as shown. The transition between skirt 52 and disk 50 is formed so that it defines another annular flexing region 54. The cover then rises upwardly and outwardly of skirt 52 through an intermediate conical wall 56 terminating with an inverted U-shaped member 58 that peripheral interface member. The transition between skirt 52 and wall 56 defines yet a fourth annular flexible region 60.

Inside U-shaped member 58 there is provided a gasket 62 formed for example of polyurethane. The U-shaped member 58 is constructed and arranged to receive the upper surface 42 of neck 36. Moreover U-shaped member has a depth about the same as the height of neck 36 so that when the cover 16 is secured to the drum body 12, the gasket not only covers the flat surface 42 but also flows around it and partially covers the neck 36 as well as the inner surface of mouth 14.

Ring 18 has a generally C-shaped cross section defined by an upper section 70 disposed generally in a plane normal to the longitudinal axis of the drum, a vertical wall 72, and a conical section 74 disposed at an angle which approximates the angle of wall 34 below neck 36. As seen in FIG. 2, the ring 18 is also provided with a locking mechanism 76 with a swing arm 78. Details of this locking mechanism are described in more detail in commonly assigned U.S. Pat. No. 4,101,156. In the position shown in FIG. 2, the ring 18 is fully extended peripherally. In this position, its inner diameter is large enough so that ring 18 fits around cover 16, as shown somewhat exaggerated in FIG. 4.

Figure 5:
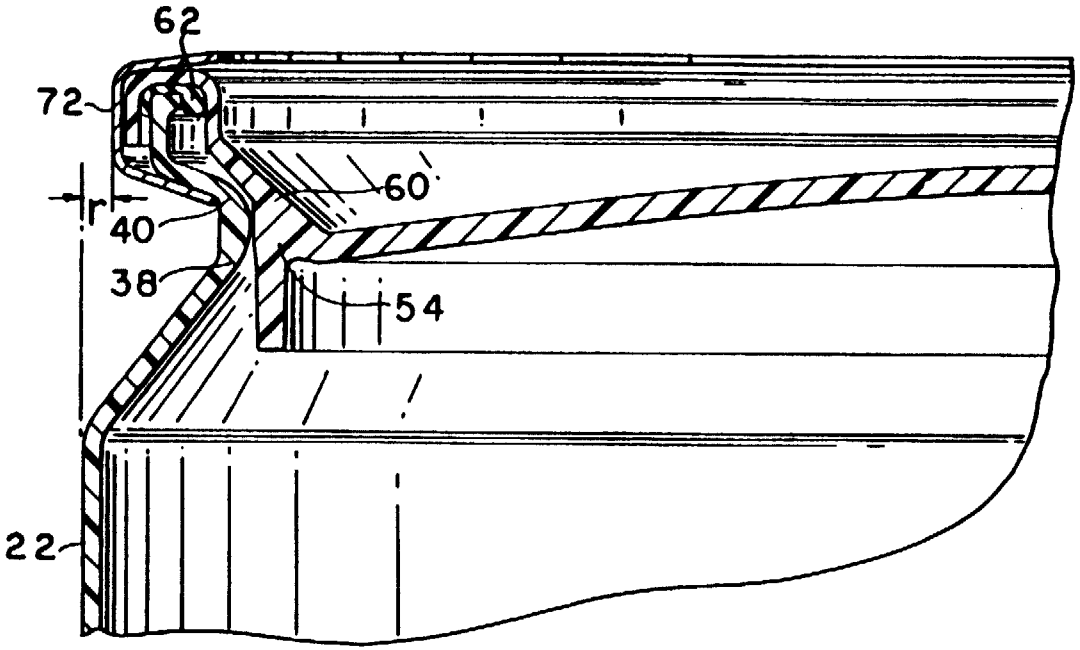
FIG. 5 shows a side-sectional view of the top portion with the ring closed.

The plastic drum described above is used as follows. First the open body 12 is filled up with a solid, semi-solid, or liquid material. Once body 12 is filled, cover 16 is placed on top of opening 14 so that the upper end of the body 12 is received in the U-shaped member 58. Next, ring 18 is placed around cover 16 and arm 78 is swung in the direction shown by arrow 80 (FIG. 2) to close and lock the ring 18. As the ring 18 closes around cover 16, ring wall 72 comes into contact with wall 34 and rides along this wall 34 downward as well as radially inward in a camming action. This camming action also forces the cover 16 downward against the top surface 42. As a result, gasket is forced to spread along top surface 42 and around the inside and outside surface of body 22 thereby providing three sealing surfaces, as shown in FIG. 5. The sealed drum shown in FIG. 1 is now ready for shipping. The lock-type ring shown in the Figures may be used for non-regulated materials.

Instead of the lock-type ring shown in the Figures, a bolt-type ring is for materials regulated by the U.N. and the DOT. A bolt type ring is described in commonly assigned U.S. Pat. No. 4,134,609.

This sealed drum has a number of advantages. The neck 36, cover 16 and ring 18 are constructed and arranged so that in the sealed configuration, the wall 72 of ring 18 is disposed radially inward by a distance r from the wall 22 of body 12. During shipping, for example if the shipping takes place in a truck over rough terrain, filled drums are bounced around and knock against each other. For other types of drums, this may cause the cover of one drum to collide with another drum and pop off. In the present drum assembly, the cover 16 and ring 18 are recessed and protected from rough handling.

Another advantage is the shape of the neck, and more particularly the sizes and shapes of walls 32 and 34. These two walls cooperate to allow the drum to be lifted by a fork lift with a parrot beak mechanism. The parrot mechanism is pushed under wall 34 adjacent wall 32 to lift the filled drum onto or off of a truck bed. Thus walls 32, 34 provide a means of handling the drum using mechanized equipment.

The drum can be sized to hold for example from 30 to 55 gallons or more, as required.

As mentioned above, a major problem with prior art plastic drums has been the drop and tip-over tests. We found that a drum as described above can pass these tests because of the arrangements of the flexible regions and the size and shape of the neck 36, cover 16 and ring 18. As shown in FIG. 5, in the sealed configuration, the flexible zones 38, 40 on the body 12 are approximately aligned with flexible zones 54, 60 on the cover 16. When the drum is dropped, for example during the drop test or the tip-over test, the hinging effect of the flexible zones permit the main portion of the body 12 to flex and distort, while the neck portion 36 remains relatively undistorted. Even if the neck 36 is distorted slightly, the cover 16 is similarly distorted because of the hinging effect of flexible regions 54, 60. In this manner the neck remains firmly sealed to the cover 16, and the gasket 62 is not crimped thereby maintaining the seal. Because of the close contact between the wall 32 and outer surfaces of the skirt 52 of the cover 16, during the tip-over test, the upper portion of body 12 is reinforced by skirt 52 on the cover. During impact, external forces travel from the neck 36 to disk 50 of cover 16. The neck 36 is also reinforced and stiffened by the cooperation with wall 72 on the ring 18. The height of these walls insure that impact is spread over a larger area.

Obviously numerous modifications may be made to this invention without departing from its scope as defined in the appended claims.

We claim

1. A plastic drum and cover assembly comprising:

a plastic cylindrical body having a cylindrical body portion with a body portion radius and a closed bottom, a neck forming an open top and coupling means for coupling said neck to said body portion, said coupling means including cylindrical wall, an upwardly and outwardly extending conical wall connecting said cylinder wall to said neck, a first annular hinge defined by the junction of the cylinder wall and the upwardly and outwardly extending conical wall, a downwardly and outwardly extending conical wall connecting said cylindrical wall to said body portion, a second annular hinge defined by the juncture of the cylindrical wall and the downwardly and outwardly extending conical wall, said cylindrical wall and hinging members having radii smaller than said body portion radius;

said annular hinges completely extending about the cylindrical body side wall providing substantially uniform degree of flexing at any point thereon upon impact;

a plastic cover for closing said open top and being radially recessed from said body side wall, covering securing means for securing said plastic cover to said body to form a seal;

said cover including a central disk and the cover securing means being disposed peripherally about said central disk for coupling said cover to said body, said cover including cover hinging means for flexing said cover in the presence of said impact to permit the cover and neck to cooperate with one another in maintaining the seal on the top, said cover hinging means being located contemporaneously with respect to said first and second annular hinges; and the hinges cooperating to isolated said neck from said body when said cover is secured by said securing means and said body is subjected to impact.

2. The drum assembly of claim 1 wherein said cover includes a gasket.

3. The assembly of claim 1 wherein said cover includes an intermediate wall extending between said peripheral interface member and said central disk with the central disk being disposed radially adjacent the cylindrical wall.

4. The assembly of claim 3 wherein said interface member comprises an inverted U-shaped member.

5. The assembly of claim 4 further comprising a gasket disposed in said U-shaped member.

6. The assembly of claim 3 wherein said intermediate wall forms an upper cover flexing region with said disk to cooperate in defining the cover hinging means.

7. The assembly of claim 3 wherein said intermediate wall extends radially outwardly for coupling to a mechanized drum handling mechanism used for lifting the drum.

8. The assembly of claim 1 wherein said cylindrical wall forms a lower cover flexing region to cooperate in defining the cover hinging means.

9. The assembly of claim 8 wherein said neck coupling means includes a first and second annular flexing regions disposed at opposite ends of the vertical wall and said lower cover flexing region is disposed approximately on the same level as said second annular flexing region on said body when said cover is closed on said body.

10. The assembly of claim 1 wherein said body sidewall has a thickness, and wherein said top surface has a radial width substantially larger than said thickness.

11. The assembly of claim 1 wherein said neck includes a second vertical wall disposed above said first vertical wall, with cover securing means including a ring dimensioned to fit about said second vertical wall.

12. The assembly of claim 11 wherein said ring includes an inclined ring wall, said inclined wall cooperating with the upwardly and outwardly extending conical wall to force said cover downward as said ring is tightened around said neck and said cover.

13. The assembly of claim 12 wherein said ring has a C-shaped cross-section.

14. The assembly of claim 1 wherein said neck includes a second cylindrical wall disposed above the first defined cylindrical wall.

15. The assembly of claim 13 wherein the ring has split ends, a locking mechanism coupled with the split ends for permitting the ring to assume an open position at which the ring may be placed about the cover and neck and a closed position at which it embraces a major part of the neck to tighten and lock the cover about the entire neck to seal the cover to the neck.

16. The assembly of claim 9 wherein the upper and lower annular hinge on the body being approximately aligned with the respective upper and lower cover flexing regions.

* * * * *